United States Patent [19]

Berneron et al.

[11] Patent Number: 5,062,900

[45] Date of Patent: Nov. 5, 1991

[54] PROCESS FOR THE IMPROVEMENT OF THE CORROSION RESISTANCE OF METALLIC MATERIALS

[75] Inventors: Roger Berneron, Gargenville; Pierre de Gelis, Saint Germain en Laye, both of France

[73] Assignee: Institut de Recherches de la Siderurgie Francaise, Paris, France

[21] Appl. No.: 458,743

[22] PCT Filed: Apr. 18, 1989

[86] PCT No.: PCT/FR89/00176

§ 371 Date: Dec. 14, 1989

§ 102(e) Date: Dec. 14, 1989

[87] PCT Pub. No.: WO89/10424

PCT Pub. Date: Nov. 2, 1989

[30] Foreign Application Priority Data

Apr. 18, 1988 [FR] France ..... 88 05091

[51] Int. Cl.[5] ..... C23F 15/00

[52] U.S. Cl. ..... 148/4; 148/1; 204/164; 427/38

[58] Field of Search ..... 148/281, 282, 285, 286, 148/287, 1, 9.5, 157, 4; 204/164, 176, 179; 427/38, 46

[56] References Cited

U.S. PATENT DOCUMENTS 4,509,451 9/1985 Collins et al. ..... 204/164

FOREIGN PATENT DOCUMENTS

| | | | |
|---|---|---|---|
| 159222 | 10/1985 | European Pat. Off. . | |
| 2508907 | 9/1975 | Fed. Rep. of Germany . | |
| 159350 | 3/1983 | Fed. Rep. of Germany . | |
| 57-025159 | 2/1982 | Japan . | |
| 58-213868 | 12/1983 | Japan . | |
| 59-105837 | 6/1984 | Japan | 204/164 |
| 60-086263 | 5/1985 | Japan . | |
| 61-056273 | 3/1986 | Japan . | |
| 61-157671 | 7/1986 | Japan | 148/281 |
| 2192196 | 1/1988 | United Kingdom . | |

OTHER PUBLICATIONS

Chemical Abstracts, vol. 99, No. 8, Aug. 1983, p. 214, No. 57309f.

Chemical Abstracts, vol. 96, No. 16, Apr. 1982, p. 283, No. 127177a.

Chemical Abstracts, vol. 97, No. 10, Sep. 1982, p. 298, No. 770342.

*Primary Examiner*—R. Dean

*Assistant Examiner*—Robert R. Koehler

*Attorney, Agent, or Firm*—Fay, Sharpe, Beall, Fagan, Minnich & McKee

[57] ABSTRACT

A subject of the invention is a process for improving the corrosion resistance of a metallic material, characterized in that the metallic material is subjected cold to a surface treatment by a low-temperature plasma, at a pressure of 1 to $10^3$ Pa in an atmosphere comprising at least one gas chosen from the following; oxygen, ozone, nitrogen, hydrogen, air, carbon dioxide, carbon monoxide, the oxides of nitrogen, water, combustion gases and mixtures of these with a neutral gas.

13 Claims, 2 Drawing Sheets

PROCESS FOR THE IMPROVEMENT OF THE CORROSION RESISTANCE OF METALLIC MATERIALS

The present invention concerns a process for improving the corrosion resistance of metallic materials such as stainless steel, ordinary steel, weakly alloyed steels, carbon steels, heat treatable steels, refractory steels, nickel based and cobalt based alloys, aluminium and its alloys, titanium and its alloys, zirconium and its alloys, zinc and its alloys, copper and its alloys.

The surface treatment of metallic materials has been carried out up until now by standard chemical reactions (oxidation, reduction conversion treatments).

Furthermore subjecting the surface of metallic materials to a surface treatment by plasma in an atmosphere composed of a rare gas such as argon, is known. With such a treatment the negatively polarised surface of the metallic material is bombarded with ions such as $Ar^+$, which causes a tearing off of the surface atoms and a preferential erosion and leads to a very high reactivity vis-a-vis the atmosphere and to an increase in roughness.

It has now been found that if the neutral monotomic gas is replaced by certain types of molecular gas, oxidants or reducers, it is possible, with a surface treatment by plasma at a low temperature (that is to say at ambient temperature), to improve the corrosion resistance of metallic materials.

Consequently a subject of the present invention is a process to improve the corrosion resistance of a metallic material, characterised in that the cold metallic material is subjected to a surface treatment by plasma at a low temperature, at a pressure from 1 to $10^3$ Pa, in an atmosphere comprising at least one gas chosen from the following: oxygen, ozone, nitrogen, hydrogen, air, carbon dioxide, carbon monoxide, the nitrogen oxides, water, combustion gases and mixtures of these with a neutral gas.

Plasma at low temperature or 'cold' plasma generally refers to plasma obtained by luminescent discharge in a low pressure atmosphere (less than $10^3$ Pa) atmosphere. The discharge is obtained in an enclosure between an anode and the negatively polarised metallic material which serves as a cathode. The metallic material to be treated is maintained at a 'cold' temperature, that is to say in practice its temperature is maintained at less than 100° C. This can be achieved using a cathode and an anode cooled by a circulation of water.

Under the influence of the electric field, the molecules of the gas are dissociated, excited or ionised; in the electric discharge thus created, a low energy plasma sweeps the surface of the material and the various gaseous types react with the surface atoms according to their chemical affinity. A large number of elements disappear from the treated surface according to whether the gases are oxidants or reducers. After treatment, the surface is generally passive vis-a-vis the atmosphere, that is to say, standard pollution elements C, S, P, O . . . .

One of the most interesting characteristics of cleaning by molecular plasma is that it does not change the surface roughness of the material even on coatings with a low softening point given the temperature of the plasma. In effect there is no erosion with a molecular gas, whereas erosion is significant with rare gases.

The reaction products, for the most part, certainly in the gaseous form, are evacuated by pumping and the others, which are positively charged can be redeposited on the cathode, for example calcium, but without however interfering with the surface.

In the present invention neutral gas denotes a rare gas such as argon, neon and helium.

Gaseous atmospheres that are particularly suitable are $N_2/O_2$, mixtures, including air, carbon dioxide, $N_2/H_2$, $H_2/Ar$.

Treatment time can be from approximately 1 second to 10 minutes. Advantageous operating voltages are between 100 and 5,000 V.

It is certain that the results previously indicated can be obtained by electric or electromagnetic fields generated by standard techniques for 'cold' plasma usually used for physical deposits in the vapour phase (magnetron, ion or electron guns, standard ionic deposits) or thermo-chemical ionic bombardment.

The metallic materials treated can notably be martensitic, ferritic, austenitic and austenoferritic stainless steels, ordinary or weakly alloyed steels, carbon steels, heat treatable steels, refractory steels, nickel based and cobalt based alloys, aluminium and its alloys, titanium and its alloys, zirconium and its alloys, zinc and its alloys, copper and its alloys.

Figure 1:
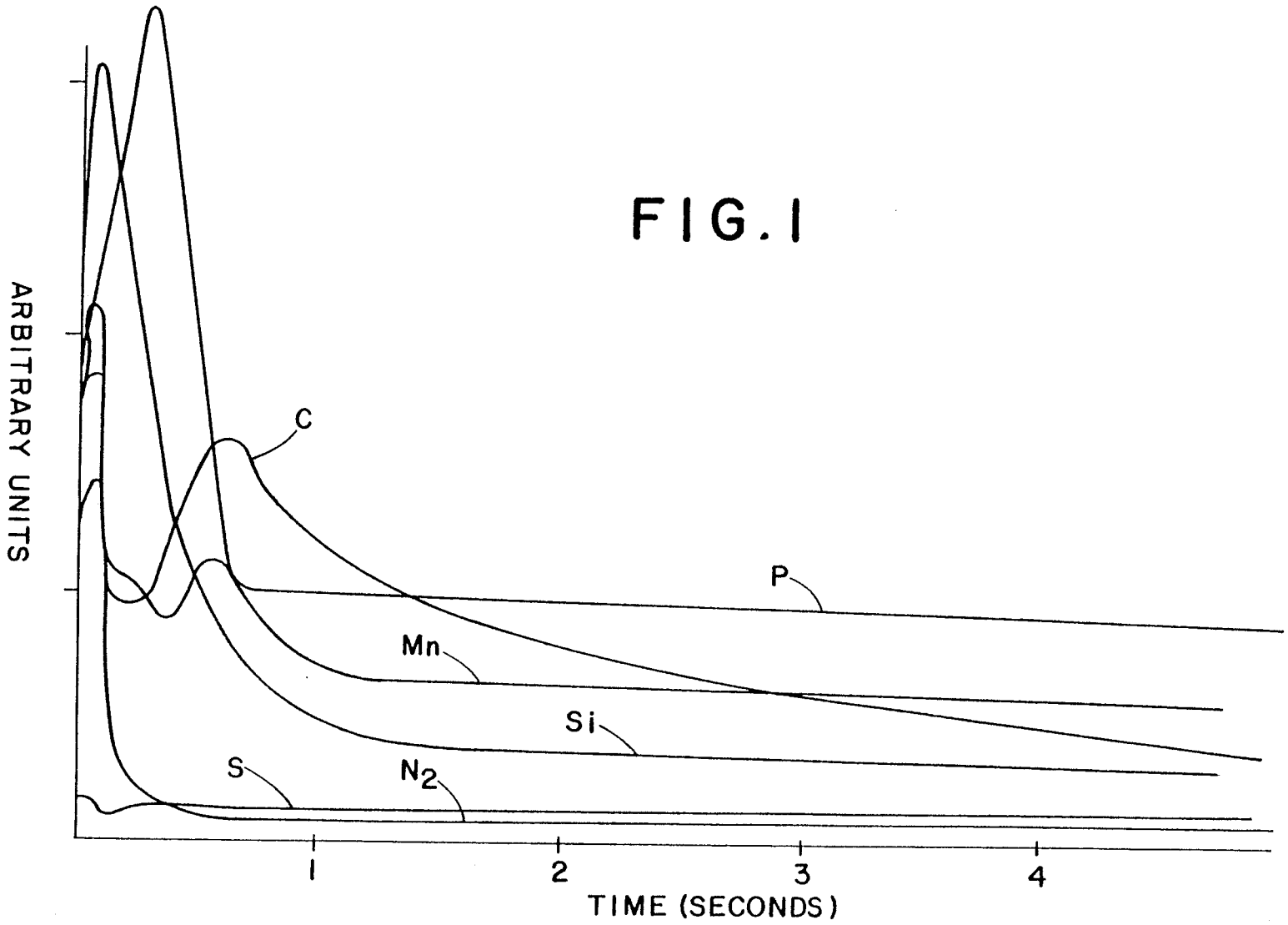
FIG. 1 shows an analysis curve using spectrometry by luminescant discharge (SLD) of an untreated stainless steel.

The following non-limiting examples, illustrate the present invention.

EXAMPLE 1

Tests were effected on ferritic stainless steel with 17% chromium.

The material was subjected to a treatment by plasma in the following conditions: pressure $10^3$ Pa, applied current 100 mA, voltage 250 V with a duration of 4 minutes, the material serving as the cathode as well as the anode being cooled by water circulation.

The gas used was a mixture $N_2/O_2$ 80/20. As a comparison an argon atmosphere was used.

The material was examined before and after treatment.

Furthermore the corrosion resistance was evaluated using the drop test.

This test consists of depositing for 5 minutes a drop of the following solution 17.0 ml $FeCl_3$ at 28%.
2.5 ml HCl.
5.0 g NaCl.
188.5 ml distilled water.

After a visual examination, the attack on the metal is rated from 1 to 3 in an increasing order of the attack on the metal.

TABLE 1

| Gas | Examination after treatment | Corrosion resistance |
|---|---|---|
| no treatment | | attack (rate 3) |
| $N_2/O_2$ 80/20 | appearance is not modified | improvement in resistance (rate 0) |
| Ar | erosion | stronger attack than for the non treated metal |

TABLE 1-continued

| Gas | Examination after treatment | Corrosion resistance |
|---|---|---|
| | | (rate >>3) |

EXAMPLE 2

Similar tests to those of example 1 are effected on a ferritic stainless steel containing 17% chromium and 1% Mo (reference FMo). The conditions being the same, except for $CO_2$ where the voltage was chosen equal to 400 V so that the discharge may be established.

The results are given in table II.

TABLE II

| Gas | Examination after treatment | Corrosion resistance |
|---|---|---|
| no treatment | | no attack (rate 0) but numerous pits. |
| air | the appearance is not modified | no attack (rate 0) some pits |
| $N_2/O_2$ 80/20 | the appearance is not modified | no attack (rate 0) no pits |
| $CO_2$ | the appearance is not modified | no attack (rate 0) some pits |
| Comparison: Ar | erosion | attack (rate 3) |

EXAMPLE 3

Similar tests to those of example 1 are effected on ferritic stainless steel containing 17% chromium and 1% molybdenum in the following conditions:

a) Treatment with argon as a comparison, b) Treatment with $N_2+O_2$ (80/20)

The material was examined before and after treatment.

Furthermore the corrosion resistance was evaluated by electrochemical measurements of the pit potential (Ep) in medium chlorinated conditions (0.02M NaCl). A voltage sweep is effected from the free potential (Ec) at the speed of 10 mV/mn. The appearance of a current indicates the formation of pits. Pit detection threshold: 100 $\mu$A.

The results are given in table III. The comparison with untreated steel shows a very weak improvement in corrosion resistance with the argon treatment and a clear improvement in the case of treatment with $N_2+O_2$. (The corrosion resistance is greater the higher the pit potential).

TABLE III

| | Ec | 1st pit | Epm Prob. 50% | Standard Deviation |
|---|---|---|---|---|
| no treatment | +20 | 244 | 440 | 60 |
| Argon | +20 | 317 | 500 | 120 |
| $N_2/O_2$ | +50 | 425 | 560 | 90 |

Potentials in mV/E.C.S.
Epm: mean potential of pit.

EXAMPLE 4

A treatment test was carried as in example 1 on bare sheets of soft steel treated under a voltage of 400 volts with a current of 200 mA in different gases under a pressure of $10^3$ Pa.

5 mn under a cold $N_2/H_2$ plasma (90/10).

5 mn under a cold $N_2/O_2$ plasma (80/20).

The sheets were left in ambient air.

After 5 months significant disparities are observed:

The sheets treated by $N_2$-$H_2$ show no beginnings of rust.

The sheets that had been subjected to $N_2$-$O_2$ show numerous pits.

The reference, simply degreased with Chlorothene, was attacked over nearly all its surface.

These results show the efficiency of the reducer treatment vis-a-vis corrosion in the case of simple exposure to the air.

Comparative analysis, using spectrometry by luminescent discharge, on stainless steel.

Measurements using spectrometry by luminescent discharge (SLD) allow the analysis of the elementary surface composition of a treated material and to compare it with the composition of a non-treated reference material.

FIG. 1 shows different characteristic curves determining the surface concentrations of elements, such as for example C, P, S, $N_2$, Si and Mn.

On the curves characteristic of a non-treated material it is noticeable that there is a high concentration of C, P, S, Si and Mn characterised by the peaks emitted from the first second of the SLD analysis.

Figure 2:
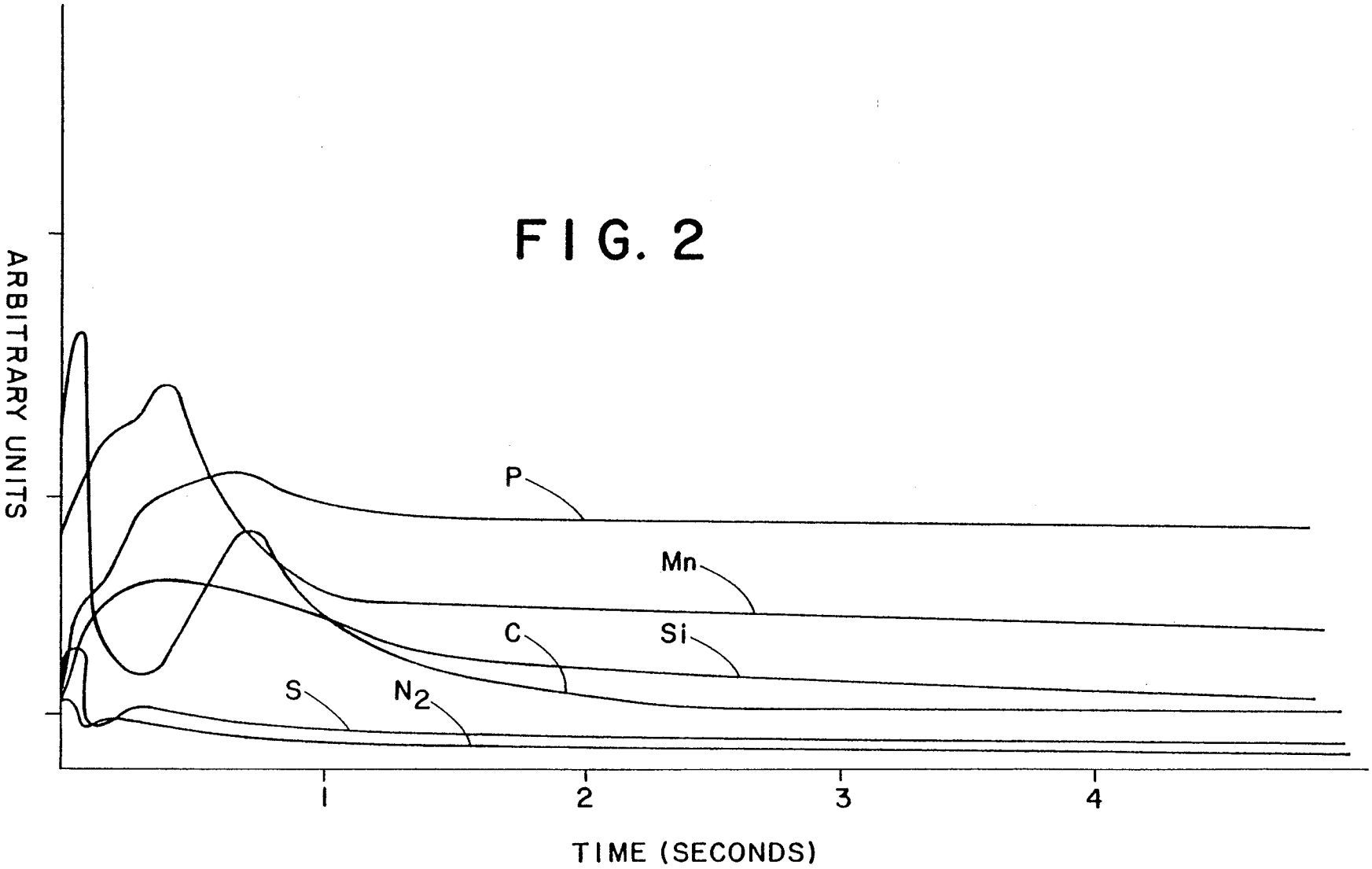
FIG. 2 shows, as a comparison, an analysis curve using SLD of the same material as in FIG. 1 after treatment under $N_2/O_2$ according to the process of the invention.

FIG. 2 shows the curves characteristic of the same elements taken, by SLD, on a same material treated by the process according to the invention.

It is noticeable that the concentration peaks emitted from the first second of the SLD analysis are very much less intense.

It can be deduced from this that the treatment eliminates the surface contaminators of the material, such as for example, P and Si.

The treatment is limited to the passivated layer in the case of stainless steels (50 to 100 A). There is neither nitriding, nor carburizing, nor implantation (as proved by the SLD analysis). The treatment consists of a modification of the state of the surface: passivation and/or amorphisation.

We claim:

1. Process for improving the corrosion resistance of a metallic material, wherein the metallic material is maintained at a temperature of less than about 100° C. while being subjected to a surface treatment by a low temperature plasma, at a pressure of from 1 to $10^3$ Pa in an atmosphere comprising at least one gas chosen from the following: oxygen, ozone, nitrogen, hydrogen air, carbon dioxide, carbon monoxide, the nitrogen oxides, water, combustion gases, and mixtures of these with a neutral gas, and wherein said material is the cathode for said treatment.

2. Process according to claim 1 wherein the treatment time is from 1 second to 10 minutes.

3. Process according to claim 1 wherein the operating voltage is from 100 to 5000 V.

4. Process according to claim 1 wherein the atmosphere is composed of oxygen and nitrogen.

5. Process according to claim 1, wherein the atmosphere is composed of carbon dioxide.

6. Process according to claim 1 wherein the metallic material is stainless steel.

7. Process according to claim 1, wherein the metallic material is ordinary or weakly alloyed steel, carbon steel, heat treatable steel or refractory steel.

8. Process according to claim 1, wherein the metallic material is of aluminium or an aluminium alloy.

9. Process according to claim 1, wherein the metallic material is of titanium or a titanium alloy.

10. Process according to claim 1, wherein the metallic material is of zirconium or a zirconium alloy.

11. Process according to claim 1, wherein the metallic material is of zinc or a zinc alloy.

12. Process according to claim 1, wherein the metallic material is a nickel-based or cobalt-based alloy.

13. Process according to claim 1, wherein the metallic material is of copper or a copper alloy.

* * * * *